US006940621B1

(12) United States Patent
Carstens

(10) Patent No.: US 6,940,621 B1
(45) Date of Patent: Sep. 6, 2005

(54) ENGRAVING MEMBER

(75) Inventor: Dieter Carstens, Kiel (DE)

(73) Assignee: Hell Gravure Systems GmbH, Kiel (DE)

( * ) Notice: Subject to any disclaimer, the term of this patent is extended or adjusted under 35 U.S.C. 154(b) by 0 days.

(21) Appl. No.: 09/720,999

(22) PCT Filed: Jun. 10, 1999

(86) PCT No.: PCT/DE99/01700

§ 371 (c)(1),
(2), (4) Date: Jan. 3, 2001

(87) PCT Pub. No.: WO00/02728

PCT Pub. Date: Jan. 20, 2000

(30) Foreign Application Priority Data

Jul. 8, 1998 (DE) ..... 198 30 471

(51) Int. Cl.[7] ..... B41C 1/02; B41C 1/04

(52) U.S. Cl. ..... 358/3.29; 358/3.32; 324/125; 409/141

(58) Field of Search ..... 358/3.29, 3.32; 324/125; 409/141; 82/1.11, 1.12, 1.4, 11.3, 82/12, 13, 82, 86, 93, 94

(56) References Cited

U.S. PATENT DOCUMENTS 3,546,586 A * 12/1970 Stimson et al. ..... 324/125
3,964,382 A * 6/1976 Baar et al. ..... 358/3.29
4,123,675 A 10/1978 Moskowitz et al.
4,357,633 A 11/1982 Buechler
4,451,856 A 5/1984 Buechler
4,805,312 A 2/1989 Dätwyler
5,816,756 A * 10/1998 Flohr et al. ..... 409/317

FOREIGN PATENT DOCUMENTS

DE 23 36 089 2/1975
WO WO 00/02728 1/2000

* cited by examiner

*Primary Examiner*—Thomas D. Lee
(74) *Attorney, Agent, or Firm*—Schiff Hardin LLP

(57) ABSTRACT

An engraving element of an electronic engraving machine for engraving printing forms is formed of a shaft oscillating around a longitudinal axis with small rotational angles. A drive system is provided for the shaft with a lever attached to one end of the shaft. An engraving stylus is provided for engraving the printing form, along with a restoring element for the shaft, a bearing for the shaft, and a damping mechanism for the shaft having a damping element secured to the shaft and a stationary damping chamber. The damping element comprises at least one damping disk that is designed circularly at least in regions and extends perpendicular to the shaft. The damping chamber is designed at least as a hollow-cylindrical segment around the shaft into which the damping disk projects and extends at least over the circular region of the damping disk. The damping chamber is filled with a ferro-fluidic fluid as a damping agent.

14 Claims, 8 Drawing Sheets

ENGRAVING MEMBER

BACKGROUND OF THE INVENTION

The invention is in the field of electronic reproduction technology and is directed to an engraving element for engraving printing forms for rotogravure as well as to a damping mechanism for an engraving element.

In an electronic engraving machine, an engraving element with an engraving stylus as a cutting tool moves along a rotating printing cylinder in the axial direction. The engraving stylus controlled by an engraving control signal cuts a sequence of cups arranged in a rotogravure raster into the generated surface of the printing cylinder. The engraving control signal is formed by superimposition of a periodic raster signal with image signal values that represent the hues to be reproduced between "black" and "white". Whereas the raster signal effects a vibrating lifting motion of the engraving stylus for generating the rotogravure raster, the image signal values control the cutting depths of the engraved cups in conformity with the hues to be reproduced.

DE-A-23 36 089 discloses an engraving element with an electromagnetic drive element for the engraving stylus. The electromagnetic drive element is composed of a stationary electromagnet charged with the engraving control signal in whose air gap the armature of a rotatory system moves. The rotatory system is composed of a shaft, the armature, a bearing for the shaft and of a damping mechanism. One shaft end merges into a stationarily clamped resilient torsion rod, whereas the other shaft end carries a lever to which the engraving stylus is attached. An electrical torque is exerted on the armature of the shaft by the magnetic field generated in the electromagnet, this electrical torque being opposed by the mechanical torque of the torsion rod. The electrical torque turns the shaft around its longitudinal axis by a rotational angle proportional to the respective image signal value, turning this from a quiescent position, and the torsion rod guides the shaft back into the quiescent position.

Due to the rotational movement of the shaft around the longitudinal axis, the engraving stylus executes a lifting motion directed in the direction onto the generated surface of the printing cylinder, this respectively defining the penetration depth of the engraving stylus into the printing cylinder.

The damping mechanism serves the purpose of defined damping of rotational oscillations and transverse oscillations of the rotatory system and, thus, for damping the movement of the engraving stylus.

Given, in particular, sudden changes in the image signal values at steep density transitions (contours), the engraving stylus can exhibit a faulty activation and deactivation behavior that is essentially dependent on the degree of damping achieved in the damping mechanism. The consequence of a faulty activation behavior of the engraving stylus is engraving errors on the printing cylinder or disturbing changes in hue in the print.

Given inadequate damping of the rotatory system, disturbing multiple contours arise at density discontinuities due to over-shooting of the engraving stylus. Given too great a damping of the rotatory system, the engraving stylus cannot follow fast enough at steep density transitions, and the rated engraving depth is only achieved or left at a distance following the density discontinuity, as a result whereof steep density discontinuities are reproduced in unsharp fashion.

Moreover, a high temperature and long-term stability of the degree of attenuation are required.

The quality in the engraving of printing forms is thus influenced substantially by the degree of damping of the engraving element.

In a first exemplary embodiment, the damping mechanism disclosed by DE-A-23 36 089 is composed of a damping element connected to the shaft of the engraving element that immerses into a stationary damping chamber filled with a damping grease as damping agent. The damping element is designed as a circular damping disk or has at least one damping wing. A damping grease loses its damping properties over time due to the mechanical stressing and thus does not exhibit the required long-term stability.

In a second exemplary embodiment, the damping mechanism disclosed by DE-A-23 36 089 comprises two or more identical damping elements axially symmetrically at the circumference and stationarily connected at the outside to a seat, these damping elements residing under pre-stress in the radial direction. The damping elements are composed of an elastic-plastic synthetic, for example of a fluor-elastomer. The degree of attenuation that can be achieved at the moment with an elastic-plastic synthetic is dependent on the respectively preceding shaping. This "memory" effect disadvantageously leads to the fact that the engraving stylus achieves and in turn departs the rated engraving depth only with a disturbing delay.

In order to achieve a higher engraving speed, efforts have been undertaken to increase the engraving frequency, i.e. the frequency of the raster signal. A higher engraving frequency, however, leads to an increased production of heat in the engraving element. The employment of damping elements composed of an elastic-plastic synthetic has the further disadvantage that this does not eliminate the heat fast enough, this potentially leading to a modification for the degree of damping and, thus, to disturbing engraving errors.

U.S. Pat. No. 4,357,633 recites another electro-mechanical engraving element having a damping mechanism. The damping mechanism is composed of a circular damping disk connected to the shaft and of a stationary, annular bearing disk between which damping elements composed of an elastic, non-compressible material are arranged.

U.S. Pat. No. 4,123,675 discloses a damping mechanism for a stepping motor drive, whereby a magnetic disk with high inertia floats in a housing filled with a ferro-fluid. The housing is rigidly connected to the shaft of the stepping motor, i.e. it turns together with the stepping motor, and the friction between the inside housing wall and the inertial disk effects the damping.

SUMMARY OF THE INVENTION

The invention is based on the object of improving an engraving element of an electronic engraving machine for engraving printing forms as well as a damping mechanism for an engraving element such that the movement of the engraving stylus of the engraving element is optimally damped in order to achieve a high engraving quality.

According to the invention, an engraving element of an electronic engraving machine for engraving printing forms has a shaft oscillating around a longitudinal axis with small rotational angles. A drive system is provided for the shaft. A lever attaches to an end of the shaft with an engraving stylus for engraving the printing form. A restoring element is provided for the shaft. An adapting mechanism for the shaft has a damping element secured to the shaft as well as a stationary damping chamber filled with a damping medium connected to the shaft via a bearing. The damping element is formed of at least one damping disk that is circular at least in regions and extending perpendicular to the shaft. The damping chamber is designed at least as a hollow cylindrical segment around the shaft into which the damping disk projects. The damping chamber extends at least over the circular regions of the damping disk. The damping medium is a ferro-fluidic fluid.

The invention is explained in greater detail below with reference to FIGS. 1 5 through 9.

FIG. 1 the schematic structure of an engraving element having a damping mechanism in a perspective view;

FIGS. 2*a*, 2*b* and 2*c* an exemplary embodiment of a rotational-symmetrical damping mechanism having a circular or circular sector-shaped damping disk, shown in section;

FIGS. 3*a* and 3*b* an exemplary embodiment of a non-rotational symmetrical damping mechanism having a circular segment-shaped damping disk, shown in section;

FIG. 4 an exemplary embodiment of a rotational-symmetrical damping mechanism having two circular or circular sector-shaped damping disks, shown in section;

FIG. 5 an exemplary embodiment of a non-rotational-symmetrical damping mechanism having two circular segment-shaped damping disks, shown in section;

FIGS. 6*a* and 6*b* a development of a rotational-symmetrical damping mechanism having an integrated spoke bearing, shown in section;

FIGS. 7*a* and 7*b* a development of a non-rotational-symmetrical damping mechanism having an integrated spoke bearing, shown in section;

FIG. 8 a perspective illustration of a rotational-symmetrically fashioned spoke bearing; and FIG. 9 a perspective illustration of a non-rotational-symmetrically fashioned spoke bearing.

FIG. 1 shows a perspective illustration of the structure of an engraving element that is fundamentally composed of a drive system—of an electromagnetic drive system in the illustrated example—and of a rotatory system.

The electromagnetic drive element is composed of a stationary electromagnet (1) having two u-shaped plate packets (2) lying opposite one another and two air gaps (3) lying between the legs of the plate packets (2). A coil (5)—which is shown from only coil side—is located in the recesses (4) of the plate packets (2) of the electromagnet (1). The coil (5) has an engraving control signal flowing through it.

The electromagnetic drive element is composed of a stationary electromagnet 1 having two u-shaped plate packets 2 lying opposite one another and two air gaps 3 lying between the legs of the plate packets 2. A coil 5—which is shown from only the coil side—is located in the recesses 4 of the plate packets 2 of the electromagnet 1. The coil 5 has an engraving control signal flowing through it.

The rotatory system is composed of a shaft 6, of an armature 7 secured to the shaft 6, as well as of a damping mechanism 8 and a spoke bearing 9 for the shaft 6. The armature 7 is movable in the air gaps 3 of the electromagnet 1. One shaft end merges into a resilient torsion bar 10 that is clamped in a stationary bearing 11, 12. The other shaft end 13 carries a lever 14 to which the engraving stylus 15 is attached. The damping mechanism 8 and the spoke bearing 9 are arranged between the armature 7 and the lever 14 with the engraving stylus 15. As a result of the magnetic field generated in the air gaps 3 of the electromagnet 1, an electrical torque is exerted on the armature 7 of the shaft 6, this electrical torque being opposed by the mechanical torque of the torsion bar 10. The electrical torque turns the shaft 6 around its longitudinal axis with a rotational angle proportional to the respective engraving control signal value, turning this out of a quiescent position, and the torsion bar 10 returns the shaft 6 into the quiescent position. As a result of the rotatory motion of the shaft 6, the engraving stylus 15 implements a stroke directed in the direction onto the generated surface of a printing cylinder (not shown) that defines the penetration depth of the engraving stylus 15 into the printing cylinder. When engraving, the rotatory system executes an oscillation motion dependent on the frequency of the raster signal by a very small rotational angle of, for example, a maximum of ±0.5°, this corresponding to a maximum stroke of approximately 250 $\mu$m of the engraving stylus 15.

The drive system for the engraving stylus 15 can also be designed as a solid-state actuator element that, for example, can be formed of a piezoelectric or of a magnetostrictive material.

FIGS. 2*a*, 2*b* show an exemplary embodiment of a rotational-symmetrical damping mechanism 8 having a circular or circular sector-shaped damping disk 17.

FIG. 2*a* shows a sectional view of the damping mechanism 8 in an axial direction of the shaft 6. The damping mechanism 8 is essentially composed of a damping disk 17 that is connected to the shaft 6 and expands perpendicular to the shaft 6 and is further composed of a stationary damping chamber 18. The damping disk 17 is designed as at least one damping wing (FIG. 2*c*) rotational-symmetrically relative to the shaft 6 either circularly (FIG. 2*b*) or circular sector-shaped. The stationary damping chamber 18 is designed as a rotational-symmetrical hollow cylinder around the shaft 6 having a u-shaped cross-section into whose interior facing toward the shaft 6 the damping disk 17 immerses. When the damping disk 17 is designed as at least one damping wing, the damping chamber 18 can be composed of hollow cylinder segments that respectively extend at least over a damping wing 17. The stationary damping chamber 18 is composed of a disk-shaped base plate 20, of a disk-shaped cover plate 21 and of a spacer ring 22 lying between base plate 20 and cover plate 21. The base plate 20 and the cover plate 21 comprise through openings 23, 24 for the shaft 6. Base plate 20, cover plate 21 and spacer ring 22 are arranged such relative to one another and connected to one another with, for example, screws 25 such that they form the interior of the damping chamber 18. The spacer ring 22 is dimensioned such that a defined damping gap 26 for the acceptance of a damping fluid arises between base plate 20, cover plate 21 and spacer ring 22 on the one hand and the damping surfaces of the damping disk 17 on the other hand.

The diameter of the through opening 24 in the cover plate 21 is selected such that an additional damping gap 26' for the damping fluid is formed between the inside surface that faces toward the shaft 6 and the generated surface of the shaft 6. The damping disk 17 can be provided with through holes 27 proceeding in the axial direction of the shaft 6. The through holes 27 form connecting channels to the damping gaps 26 above and below the damping disk 17 and advantageously serve for compensating the damping fluid and as a reservoir for the damping fluid. Over and above this, the through holes 27 reduce axial vibrations of the damping disk 17.

A ferro-fluidic fluid is preferably employed as a damping fluid in the damping chamber (18). A ferro-fluidic fluid is a colloidal solution of magnetic particles in an oil that can be magnetized. A ferro-fluidic fluid is commercially obtainable under the trade name Ferrofluiddics® of ferro fluidics GmbH.

The degree of attenuation that can be achieved with a damping fluid is advantageously independent of the respectively preceding deformation, so that no "memory" effect arises that would lead to disturbing engraving errors. Over and above this, the degree of damping that can be achieved with a damping fluid can be approximately calculated. A high temperature stability and long-term stability of the degree of damping is also achieved with a damping fluid, since the heat arising as a result of high engraving frequencies can be eliminated well via the damping fluid. The described exemplary embodiment employs a ferrofluidic damping fluid that is held in the damping gap 26 by a magnetic field generated with a magnet, as a result whereof complicated seals can be eliminated. In the exemplary embodiment, an annular retaining magnet 28 for the ferrofluid is located in an annular channel 29 in the base plate 20 of the damping chamber 18. In order to prevent dust from entering into the damping chamber 18, a seal ring 30 embracing the shaft 6 can be provided, this being located in a recess 31 of the base plate 20.

FIG. 2*b* shows a section through the damping mechanism 8 in a plane proceeding perpendicular to the axial direction of the shaft 6. The sectional view shows the circularly designed damping disk 17.

FIG. 2*c* again shows a section through the damping mechanism 8 in a plane proceeding perpendicular to the axial direction of the shaft 6. The sectional view shows the design of the circular sector-shaped damping disk 17 as two damping wings.

FIG. 3 shows an exemplary embodiment of a non-rotational-symmetrical damping mechanism 8 having a circular segment-shaped damping disk 1.

FIG. 3*a* again shows a section through the damping mechanism 8 in the axial direction of the shaft 6, whereby the damping disk 17 and the damping chamber 18 are designed as circular or hollow-cylindrical segments that are not rotationally symmetrical with respect to the axis of the shaft 6. This embodiment can be advantageously employed when an optimally slight distance of the shaft 6 of the engraving element from the generated surface of a printing cylinder is desired. The damping disk 17 is designed as a circular segment, whereby the edge of the damping disk 17 forming the chord lies as close as possible to the shaft 6. The damping chamber 18 is designed as a hollow cylinder segment corresponding to the shape of the damping disk 17 designed as a circular segment. The fundamental structure of the damping chamber 18 is basically identical to the structure of the damping chamber 18 shown in FIG. 2*a*.

FIG. 3*b* shows a section through the damping mechanism 8 in a plane proceeding perpendicular to the axial direction of the shaft 6. The sectional view shows the design of the damping disk 17 as circular segment.

FIG. 4 shows an exemplary embodiment of a rotational-symmetrical damping mechanism 8 having two circular or circular sector-shaped damping disks 17, 17' in a section in an axial direction of the shaft 6.

The damping mechanism 8 is basically constructed like the damping mechanism 8 according to FIG. 2*a*. It differs from the damping mechanism (8) shown in FIG. 2*a* in that two damping disks 17, 17' arranged parallel to one another and spaced from one another in the axial direction of the shaft 6 are connected as a double disk to the shaft 6, and in that the damping chamber 18 is divided by an intermediate plate 32 in two sub-chambers 33, 33' for the two damping disks 17, 17'. The intermediate plate 32 is thereby dimensioned such that the two sub-chambers 33, 33' are connected to one another by an additional damping gap 26'. The damping disks (17, 17') are shaped as shown in FIG. 2*a* or FIG. 2*c*).

FIG. 5 shows an exemplary embodiment of a non-rotational-symmetrical damping mechanism 8 having two circular segment-shaped damping disks 17, 17' in a sectional view in the axial direction of the shaft 6. The damping mechanism 8 is fundamentally constructed as described in FIG. 4. The damping disks 17, 17' are shaped as shown in FIG. 3*b*.

The damping disk 17 is made, for example, of aluminum or steel. Base plate 20, cover plate 21, spacer ring 22 and intermediate plate 32 are preferably composed of non-magnetic material.

The two damping disks 17, 17' can be supplemented by further damping disks. The employment of more than one damping disk has the advantage that a higher degree of damping is achieved due to the increased damping area that interacts with the damping fluid. Given an identical damping area, the diameter of the individual damping disks can be reduced given employment of a plurality of damping disks. This preferably leads to a lower mass moment of inertia and to lower circumferential speeds at the edges of the damping disks. This reduces the risk that the damping fluid will modify and deteriorate the damping property.

FIG. 6 shows a development wherein the rotational-symmetrical damping mechanism 8 is structurally combined with the rotational-symmetrically fashioned spoke bearing 9.

FIG. 6*a* shows a section through the damping mechanism 8 in the axial direction of the shaft 6, this agreeing with the sectional view of the damping mechanism 8 shown in FIG. 2*a* except for the spoke bearing 9. The rotational-symmetrical spoke bearing 9 is composed of an inside ring 35 embracing the shaft 6 and connected thereto, of a stationary outer ring 36 surrounding the shaft 6 and spaced from the inner ring 35, and of a plurality of leaf springs 37 proceeding radially at identical or irregular angular spacings. The broadsides are directed in the axial direction of the shaft 6, so that the inner ring 35 is torsionally seated relative to the stationary outer ring 36, namely around the longitudinal axis of the shaft 6. The ends of the leaf springs 37 are respectively clamped in the two rings 35, 36. Outer ring 36 and cover plate 21 of the damping chamber 18 are preferably fabricated as one component part.

FIG. 6*b* shows a section through the rotational-symmetrical spoke bearing 9 in a plane proceeding perpendicular to the axial direction of the shaft 6.

FIG. 7 shows a development wherein the non-rotational-symmetrical damping mechanism 8 is structurally united with the non-rotationally-symmetrically designed spoke bearing 9.

FIG. 7*a* shows a section through the non-rotational-symmetrical damping mechanism 8 in the axial direction of the shaft 6, this coinciding with the section through the damping mechanism 8 shown in FIG. 3*a* except for the structurally integrated spoke bearing 9. The non-rotational-symmetrical spoke bearing 9 is composed of an inner ring 35 that surrounds the shaft 36 and is connected thereto, of a stationary outer ring segment 36' that surrounds the shaft 6 and is spaced from the inner ring 35', and of a plurality of radially proceeding leaf springs 37' whose broad sides are likewise directed in axial direction of the shaft 6 and whose ends are respectively secured in the inner ring 35' and in the outer ring segment 36'. Outer ring segment 36' and circular segment-shaped cover plate 21 of the damping chamber 18 are again a shared component part.

FIG. 7*b* shows a section through the non-rotational-symmetrical spoke bearing 9 in a plane proceeding perpendicular to the axial direction of the shaft 6.

Figure 1:
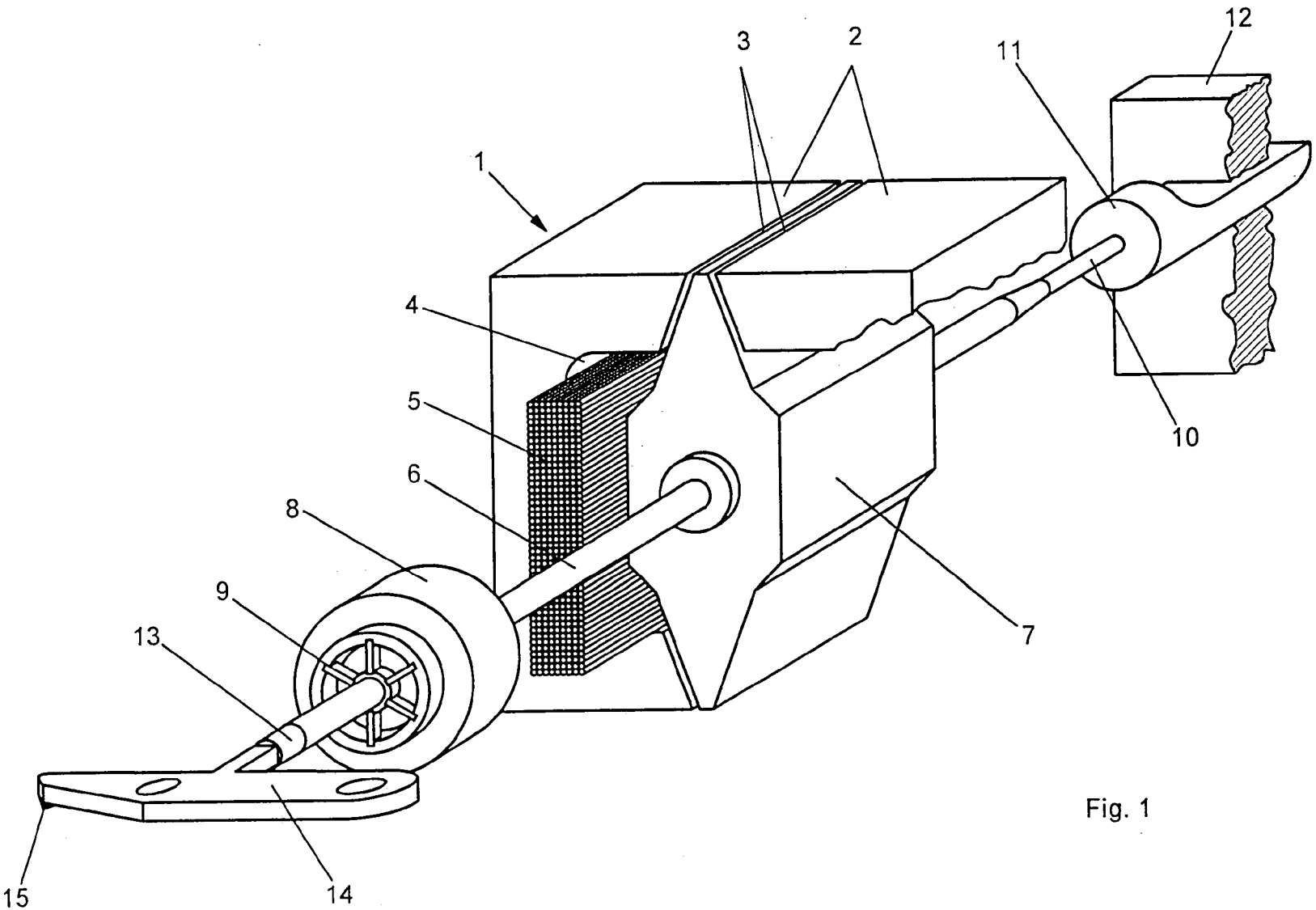
Figure 2A:
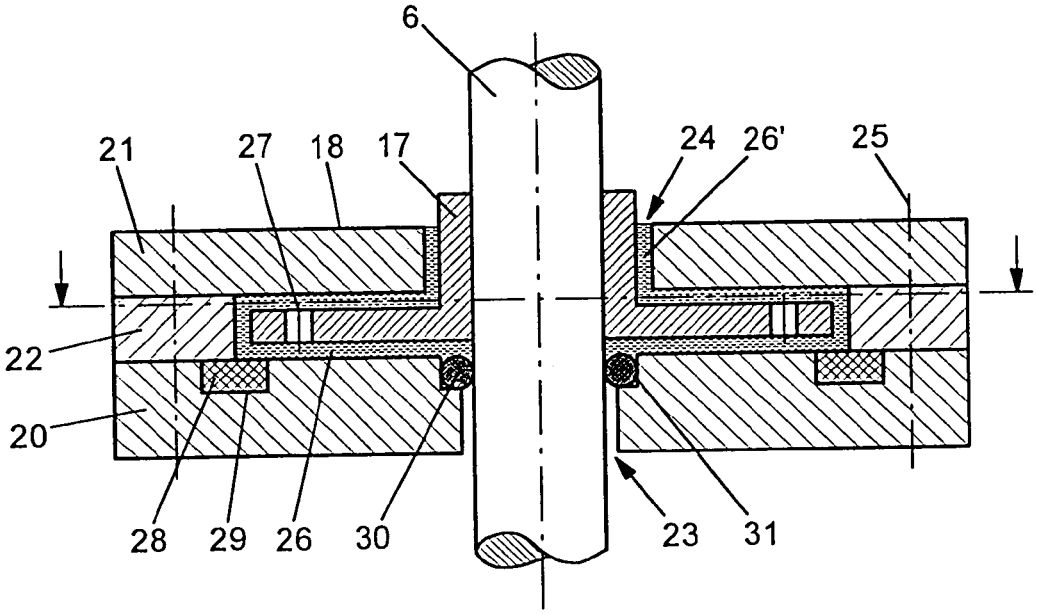
Figure 2B:
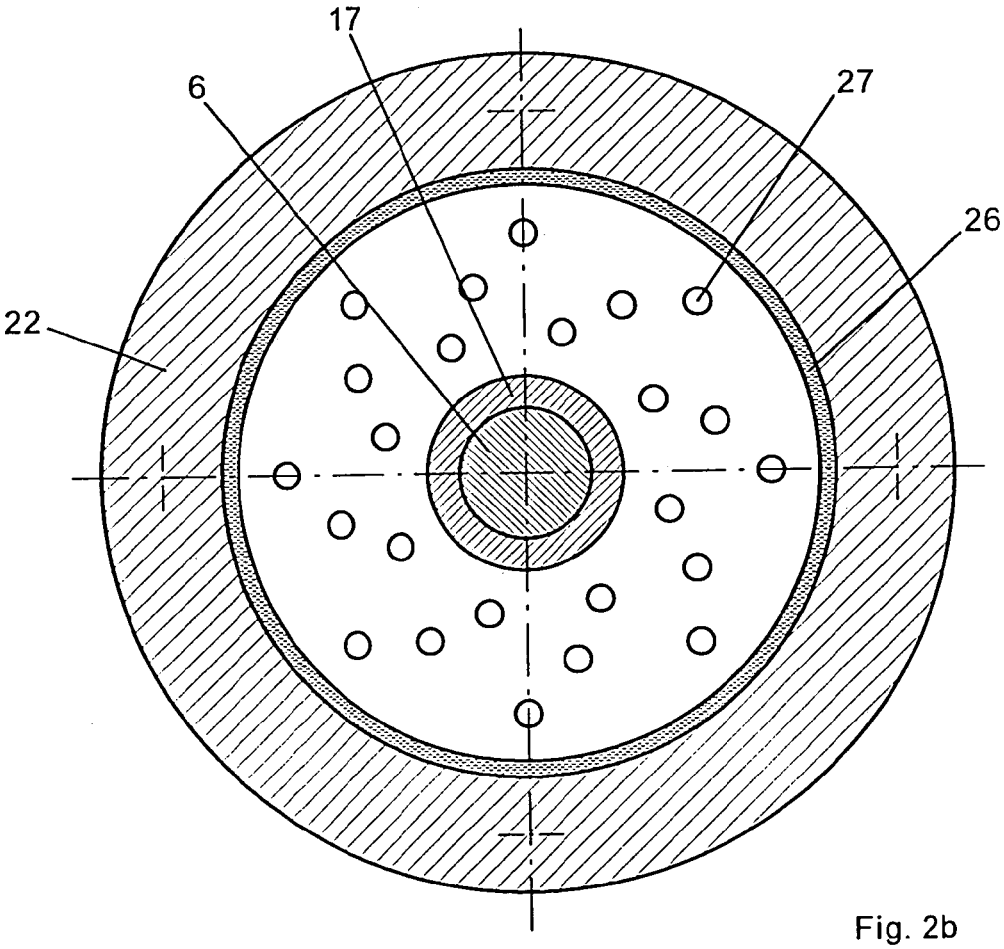
Figure 2C:
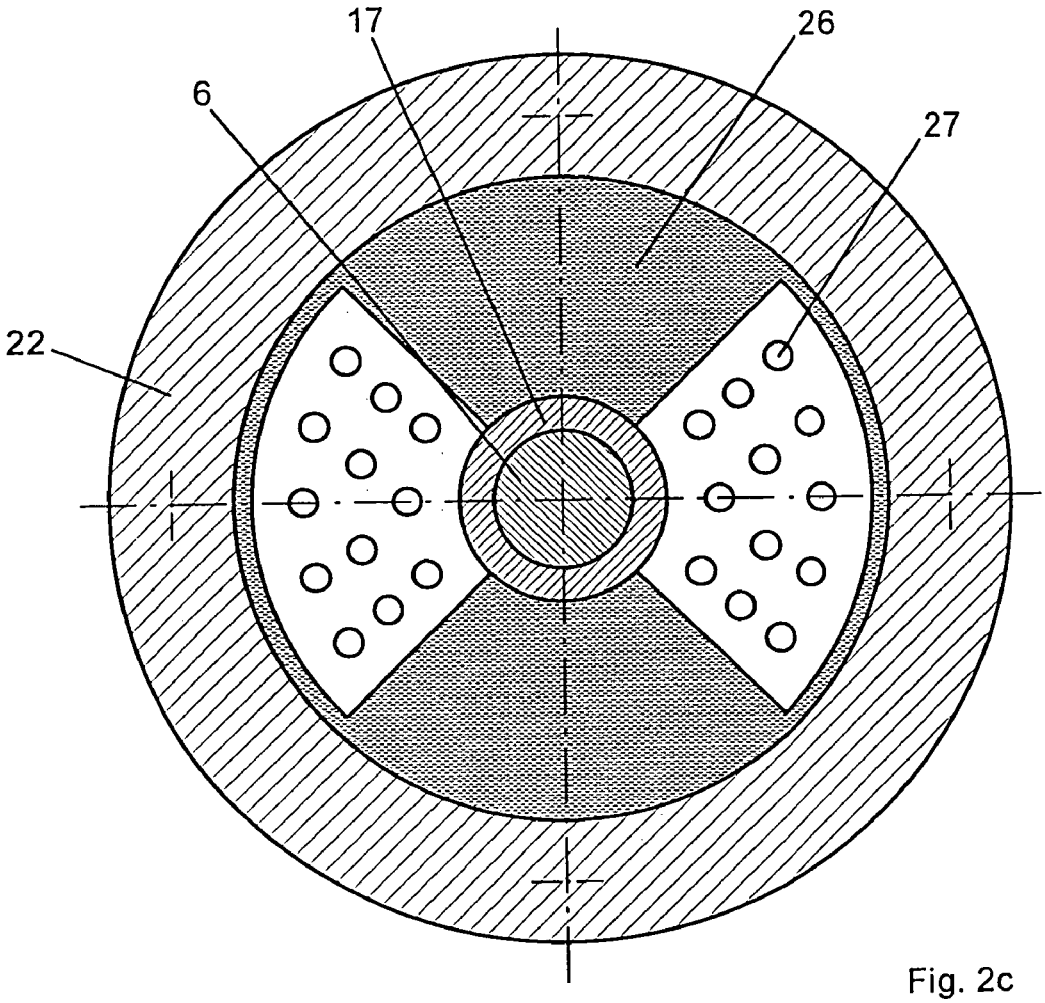
Figure 3A:
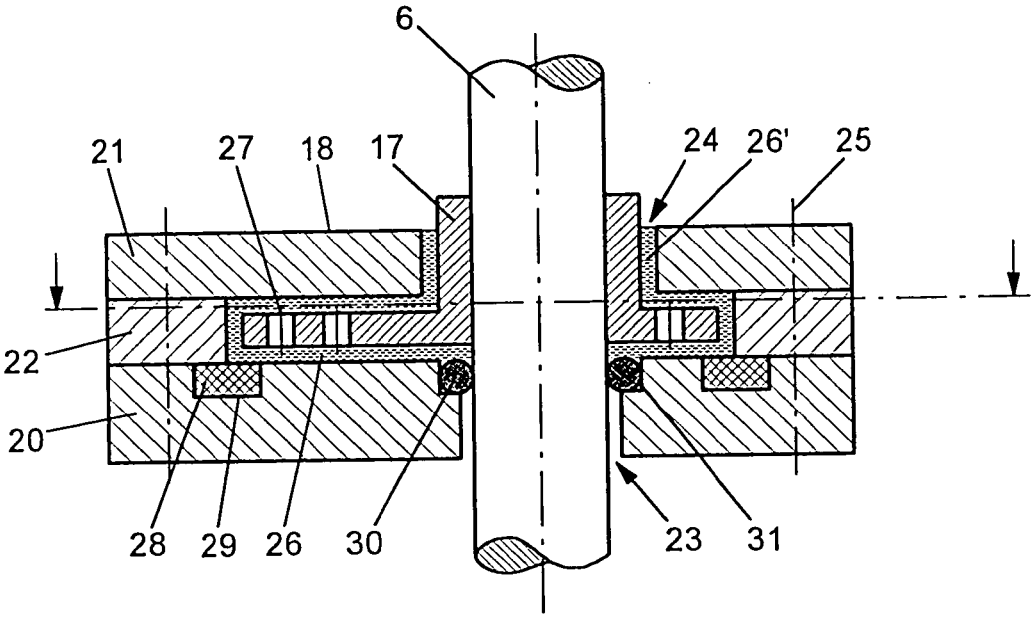
Figure 3B:
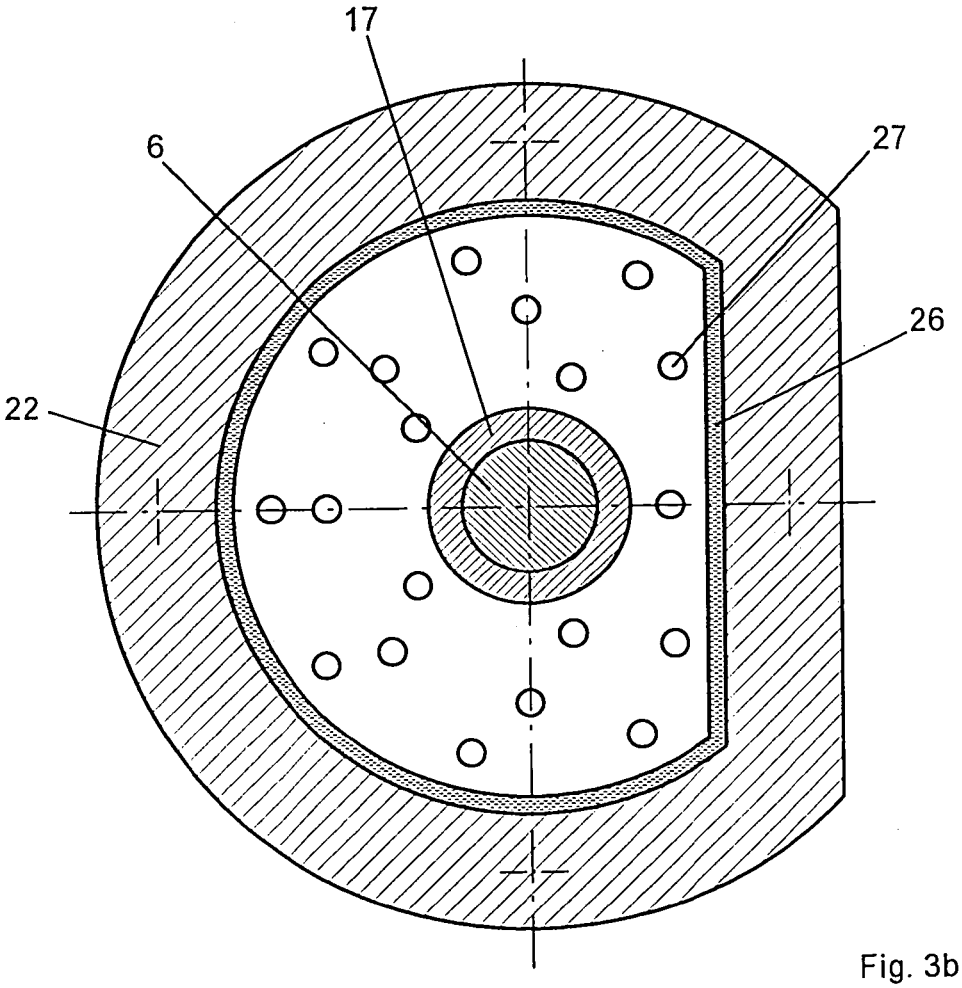
Figure 4:
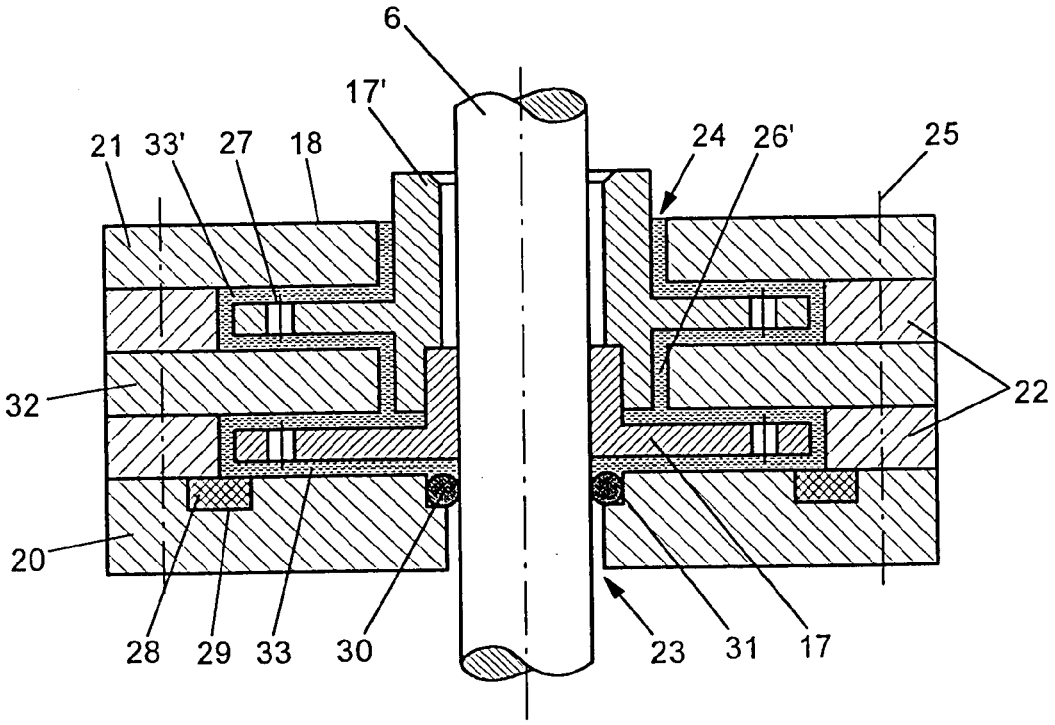
Figure 5:
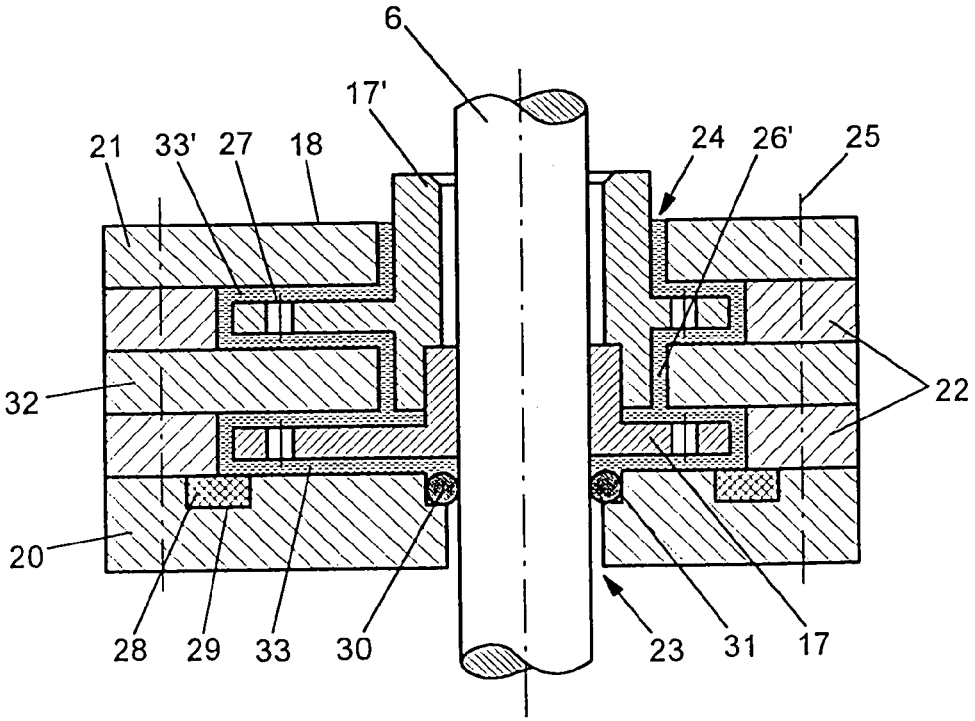
Figure 6A:
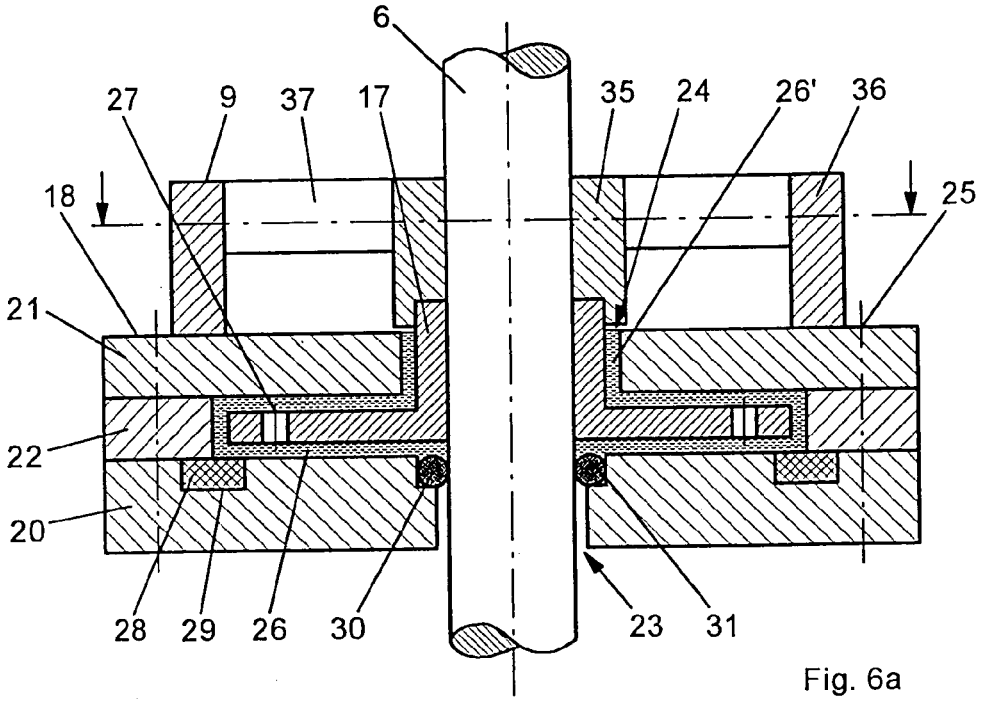
Figure 6B:
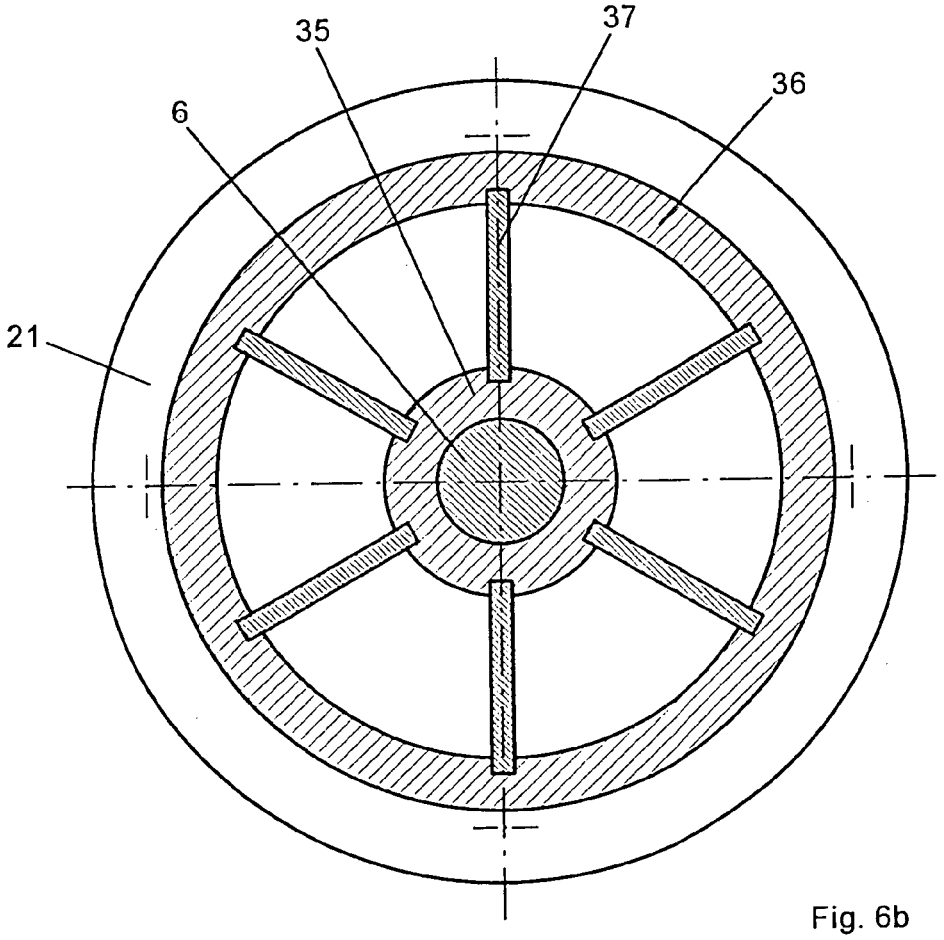
Figure 7A:
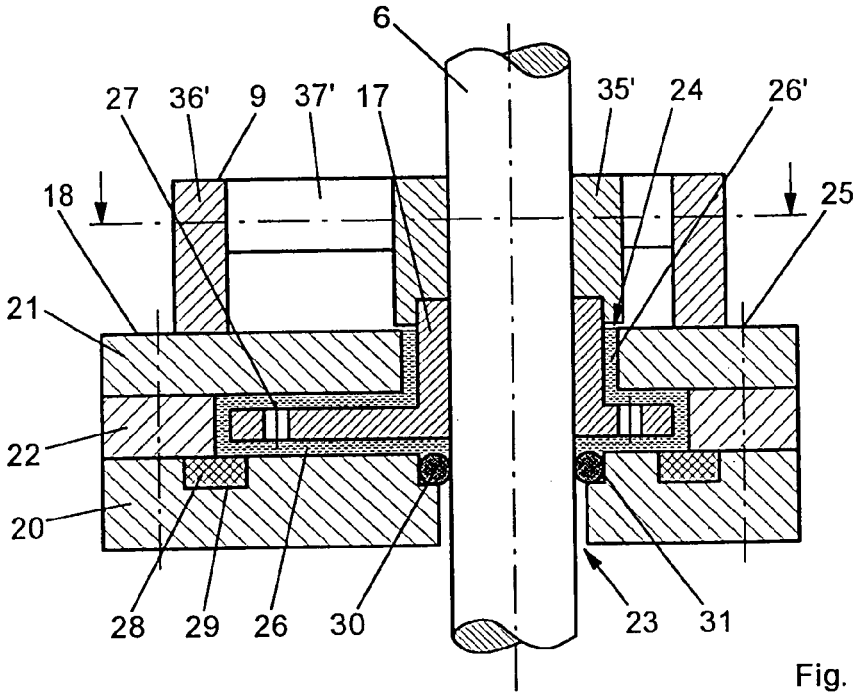
Figure 7B:
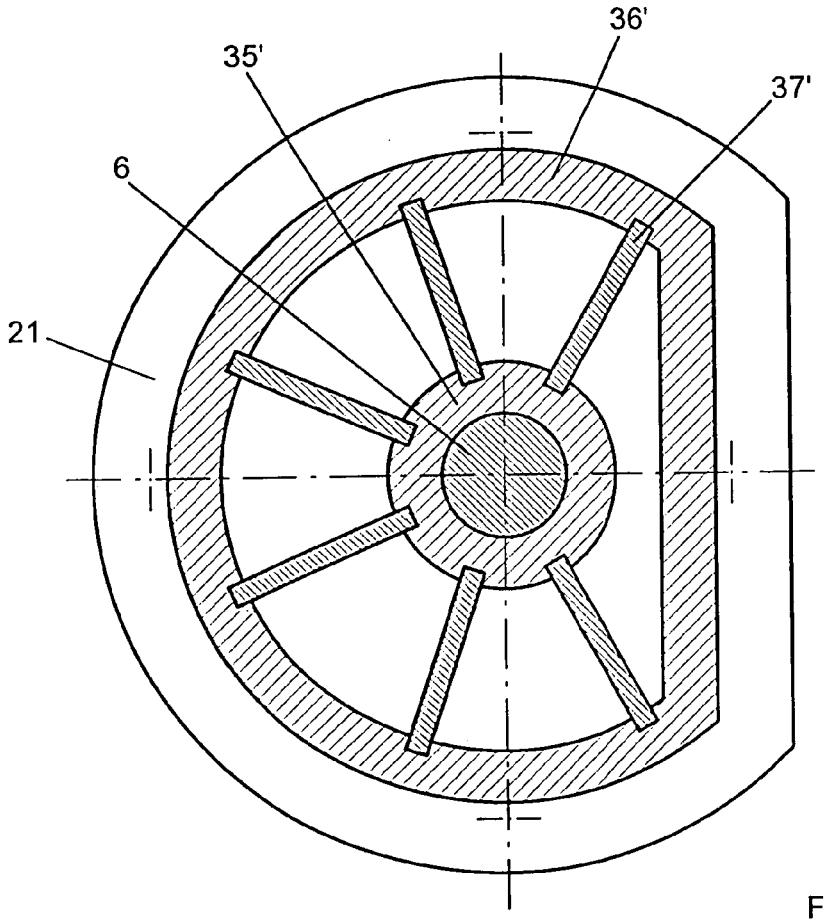
Figure 8:
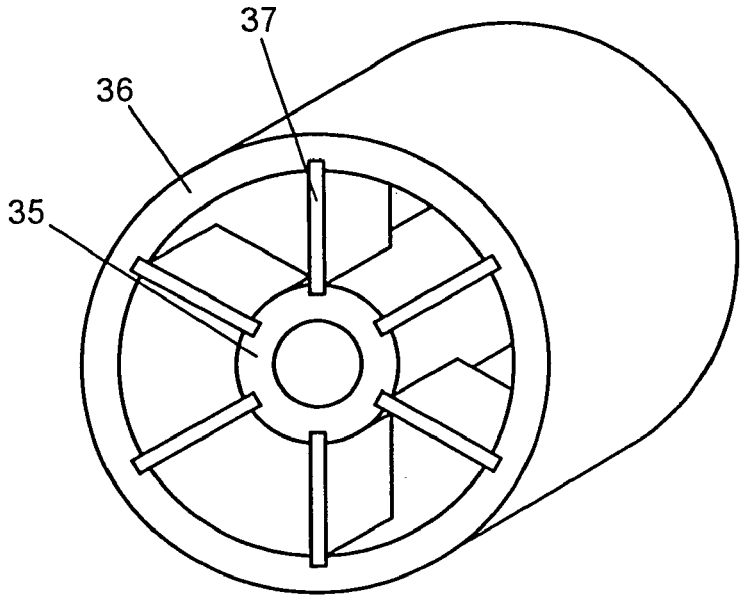
FIG. 8 shows a perspective view of a rotational-symmetrically fashioned spoke bearing 9.
Figure 9:
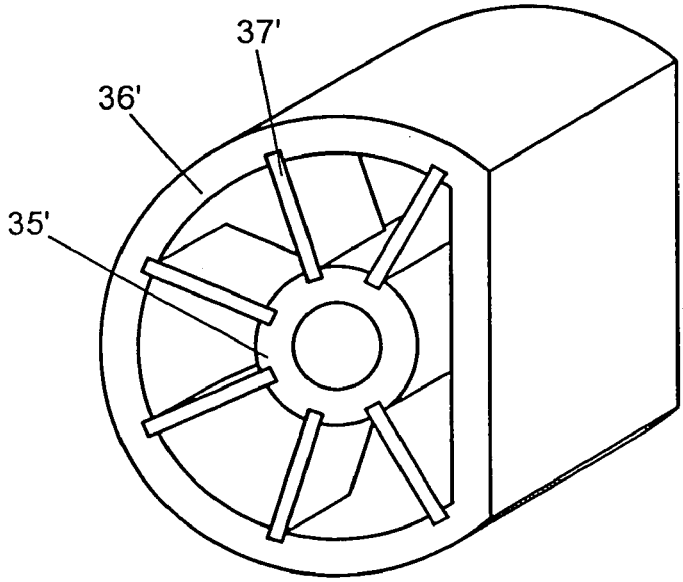
FIG. 9 shows a perspective view of a non-rotational-symmetrically designed spoke bearing 9.

Although various minor changes and modifications might be proposed by those skilled in the art, it will be understood that my wish is to include within the claims of the patent warranted hereon all such changes and modifications as reasonably come within my contribution to the art.

I claim:

1. An engraving element of an electronic engraving machine for engraving printing forms, comprising:

a shaft oscillating around a longitudinal axis with small rotational angles;

a drive system for the shaft;

a lever attached to an end of the shaft with an engraving stylus for engraving the printing form;

a restoring element for the shaft;

a damping mechanism for the shaft having a damping element secured to the shaft as well as a stationary damping chamber filled with a damping medium connected to the shaft via a flexible bearing;

the damping element being formed of at least one damping disk that is circular at least in regions and extending perpendicular to the shaft;

the damping chamber being designed at least as a hollow-cylindrical segment around the shaft into which the damping disk projects;

the damping chamber extending at least over the circular regions of the damping disk;

the damping medium being a ferro-fluidic fluid; and the flexible bearing comprising a plurality of flexible elements connecting the damping disk to the stationary damping chamber so that as the shaft oscillates the flexible elements bend, the flexible elements together with the ferro-fluidic fluid damping the oscillating shaft.

2. The engraving element according to claim 1 wherein the drive system for the shaft is designed as one of a piezoelectric and a magnetostrictive drive element.

3. The engraving element according to claim 1 wherein the flexible bearing comprises leaf springs as said flexible elements.

4. An engraving element of an electronic engraving machine for engraving printing forms, comprising:

a shaft oscillating around a longitudinal axis with small rotational angles;

a drive system for the shaft;

a lever attached to an end of the shaft with an engraving stylus for engraving the printing form;

a restoring element for the shaft;

a damping mechanism for the shaft having a damping element secured to the shaft as well as a stationary damping chamber filled with a damping medium connected to the shaft via a bearing;

the damping element being formed of at least one damping disk that is circular at least in regions and extending perpendicular to the shaft;

the damping chamber being designed at least as a hollow-cylindrical segment around the shaft into which the damping disk projects;

the damping chamber extending at least over the circular regions of the damping disk;

the damping medium being a ferro-fluidic fluid; and the damping mechanism is not rotationally symmetrical relative to an axial direction of the shaft.

5. An engraving element of an electronic engraving machine for engraving printing forms, comprising:

a shaft oscillating around a longitudinal axis with small rotational angles;

a drive system for the shaft;

a lever attached to an end of the shaft with an engraving stylus for engraving the printing form;

a restoring element for the shaft;

a damping mechanism for the shaft having a damping element secured to the shaft as well as a stationary damping chamber filled with a damping medium connected to the shaft via a bearing;

the damping element being formed of at least one damping disk that is circular at least in regions and extending perpendicular to the shaft;

the damping chamber being designed at least as a hollow-cylindrical segment around the shaft into which the damping disk projects;

the damping chamber extending at least over the circular regions of the damping disk;

the damping medium being a ferro-fluidic fluid; and the damping element is provided with through holes proceeding in an axial direction of the shaft.

6. An engraving element of an electronic engraving machine for engraving printing forms, comprising:

a shaft oscillating around a longitudinal axis with small rotational angles;

a drive system for the shaft;

a lever attached to an end of the shaft with an engraving stylus for engraving the printing form;

a restoring element for the shaft;

a damping mechanism for the shaft having a damping element secured to the shaft as well as a stationary damping chamber filled with a damping medium connected to the shaft via a bearing;

the damping element being formed of at least one damping disk that is circular at least in regions and extending perpendicular to the shaft;

the damping chamber being designed at least as a hollow-cylindrical segment around the shaft into which the damping disk projects;

the damping chamber extending at least over the circular regions of the damping disk;

the damping medium being a ferro-fluidic fluid; and the bearing connected to the shaft comprises a spoke bearing.

7. The engraving element according to claim 6 wherein the spoke bearing is formed of:

an inner ring surrounding and connected to the shaft;

one of a stationary outer ring and an outer ring segment surrounding the shaft at least in regions and spaced from the inner ring; and a plurality of leaf springs as the spokes of said spoke bearing proceeding radially relative to the shaft whose ends are respectively connected to the inner ring and to one of the outer ring and the outer ring segment.

8. The engraving element according to claim 6 wherein the damping mechanism and the spoke bearing are structurally united with one another.

9. A damping mechanism for an engraving element for engraving printing forms, comprising:

a damping element secured to a shaft of the engraving element oscillating around a longitudinal axis with small rotational angles;

a stationary damping chamber filled with a damping medium;

the damping element being formed of at least one damping disk circular at least in regions and extending perpendicular to the shaft;

the damping chamber being designed at least as a hollow-cylindrical segment around the shaft into which the damping disk projects;

the hollow-cylindrical damping chamber extending at least over the circular regions of the damping disk;

the damping medium comprising a ferro-fluidic fluid; and a plurality of flexible elements connecting the damping disk to the stationary damping chamber so that as the shaft oscillates the flexible elements bend, the flexible elements together with the ferro-fluidic fluid damping the oscillating shaft.

10. The damping mechanism according to claim 9 wherein the stationary damping chamber is connected to the shaft by a flexible bearing.

11. The damping mechanism of claim 10 wherein the flexible bearing has leaf spring spokes.

12. A damping mechanism for an engraving element for engraving printing forms, comprising:

a damping element secured to a shaft of the engraving element oscillating around a longitudinal axis with small rotational angles;

a stationary damping chamber filled with a damping medium;

the damping element being formed of at least one damping disk circular at least in regions and extending perpendicular to the shaft;

the damping chamber being designed at least as a hollow-cylindrical segment around the shaft into which the damping disk projects;

the hollow-cylindrical damping chamber extending at least over the circular regions of the damping disk;

the damping medium comprising a ferro-fluidic fluid; and the damping mechanism having a shape which is not rotational-symmetrical to an axial direction of the shaft.

13. A damping mechanism for an engraving element for engraving printing forms, comprising:

a damping element secured to a shaft of the engraving element oscillating around a longitudinal axis with small rotational angles;

a stationary damping chamber filled with a damping medium;

the damping element being formed of at least one damping disk circular at least in regions and extending perpendicular to the shaft;

the damping chamber being designed at least as a hollow-cylindrical segment around the shaft into which the damping disk projects;

the hollow-cylindrical damping chamber extending at least over the circular regions of the damping disk;

the damping medium comprising a ferro-fluidic fluid; and the damping element is provided with through holes proceeding in an axial direction of the shaft.

14. A damping mechanism for an engraving element for engraving printing forms, comprising:

a damping element secured to a shaft of the engraving element oscillating around a longitudinal axis;

a damping chamber filled with a damping medium;

the damping element being formed of at least one damping disk and extending perpendicular to the shaft;

the damping chamber being designed at least as a hollow-cylindrical segment around the shaft into which the damping disk projects;

the hollow-cylindrical damping chamber extending over the damping disk;

the damping medium comprising a ferro-fluidic fluid; and a plurality of flexible elements connecting the damping disk to the stationary damping chamber so that as the shaft oscillates the flexible elements bend, the flexible elements together with the ferro-fluidic fluid damping the oscillating shaft.

* * * * *